United States Patent [19]

Seki et al.

[11] Patent Number: 4,518,333

[45] Date of Patent: May 21, 1985

[54] ROTARY BLADE PUMP HAVING BLADES WITH WEAR RESISTANT END SURFACES

[75] Inventors: Kimiaki Seki, Kasai; Akio Matsumoto, Kanzaki, both of Japan

[73] Assignee: Mitsubishi Denki Kabushiki Kaisha, Tokyo, Japan

[21] Appl. No.: 576,407

[22] Filed: Feb. 2, 1984

[30] Foreign Application Priority Data

Feb. 21, 1983 [JP] Japan ..... 58-28743

[51] Int. Cl.[3] ..... F04C 2/00; F04C 15/00

[52] U.S. Cl. ..... 418/152; 418/178

[58] Field of Search ..... 418/152, 178

[56] References Cited

U.S. PATENT DOCUMENTS

| | | | |
|---|---|---|---|
| 3,187,679 | 6/1965 | Scognamills | 418/257 |
| 3,187,699 | 6/1965 | Bryant et al. . | |
| 3,281,064 | 10/1966 | Springer | 418/152 X |
| 3,485,179 | 12/1969 | Dawes | 418/152 |
| 3,552,895 | 1/1971 | Bayley | 418/178 |
| 4,209,286 | 6/1980 | Schwartz | 418/178 |

FOREIGN PATENT DOCUMENTS

| | | | |
|---|---|---|---|
| 2355996 | 5/1975 | Fed. Rep. of Germany | 418/152 |
| 47-50526 | 12/1972 | Japan | 418/152 |
| 958703 | 9/1982 | U.S.S.R. | 418/152 |

*Primary Examiner*—John J. Vrablik
*Assistant Examiner*—Ted Olds
*Attorney, Agent, or Firm*—Wenderoth, Lind & Ponack

[57] ABSTRACT

A blade for a pump means of the type comprising a rotor rotatably supported within a housing with its center line being eccentrically disposed with respect thereto and a number of blades each shiftably received in respective radial slots formed in the rotor is disclosed. The base body of the blade is constituted from a solid lubricating material such as graphite and only its axial end surfaces are covered by layers of a synthetic resin which has excellent wear resistance, excellent heat resistance, and a low coefficient of friction.

3 Claims, 4 Drawing Figures

ROTARY BLADE PUMP HAVING BLADES WITH WEAR RESISTANT END SURFACES

BACKGROUND OF THE INVENTION

The present invention relates to a pump and more particularly to a rotary blade pump in which the pump characteristics and the ability of the blades to shift relative to the pump body are improved.

Hitherto, for example, as disclosed in U.S. Pat. No. 3,187,679 of F. Scognamills, the pump means rotary pump shown in FIGS. 1 and 2 of the attached drawings has been publicly known. In these drawings reference numeral 1 designates a bracket of an electric motor (not shown), reference numeral 2 designates a rotary shaft of this motor journaled in the bracket 1 by a bearing 3, and reference numeral 4 designates a rotor splined to the rotary shaft 2 concentrically, the rotor 4 radially shiftably receiving a number of blades 5 (the number being three in this embodiment) respectively within radial slots formed therein. Reference numeral 6 designates a cylindrical housing the inner periphery of which has a center line disposed eccentrically with respect to the center line of the rotary shaft 2 and of the rotor 4, and reference numerals 7 and 8 designate suction and discharge ports, respectively, formed in the housing 6 substantially at opposite sides of the rotor 4.

The operation of the pump means shown in FIGS. 1 and 2 is as follows.

Upon rotation of the rotary shaft 2 in the direction indicated by the arrow in FIG. 2, the blades 5 driven together with the rotor 4 are caused to protrude radially outwards by the action of centrifugal force so that they displace with their radially outer peripheries into abutment with the inner periphery of the housing 2 while radially shifting relative thereto, whereby the air within a vacuum tank (not shown) is sucked through the suction port 7 and discharged through the discharge port 8. In this manner, a pumping action takes place in a manner well known in the art.

However, since it is usual in the pump means of this kind that each blade 5 is constituted from a material having an abrasive quality such as carbon, graphite, or the like, the end surfaces 5*a* and 5*b* at the extreme longitudinal ends of the blades 5, which confront and carry out a shifting movement relative to the confronting surfaces of the housing 6 and the bracket 1, are subject to abrasion, the bracket 1 and housing 6 being made of aluminium, pig iron, or the like. This results in a decrease in pump performance and deterioration of the ability of the blades to shift relative to the bracket 1 and the housing 6 owing to their jamming, and in extreme cases even the locking of blades may occur.

For the purpose of providing a non-lubricated blade for a pump means of this kind there is disclosed in Japanese Laid-Open Utility Model Publication No. 161611/1979 a blade in which the basic portion is made of a thermosetting resin containing inorganic or organic substances as a filler, and the surface portions such as the side surfaces confronting the slot formed in the rotor and the radially outward peripheral surface coming into contact with the inner peripheral surface of the housing are formed from a material which has excellent wear resistance and a low coefficient of friction. However, in this blade no consideration is given to the end surfaces 5*b* and 5*a* at the extreme longitudinal ends of the blade 5 which shift relative to the bracket and the housing during pump operation.

Further, in this prior art, since the side surfaces of the blade to be shifted relative to the slot formed in the rotor and the radially outward peripheral surface thereof to be shifted relative to the inner peripheral surface of the housing are formed from a material having a superior wear resistance and a low coefficient of friction:

(i) the inner peripheral surface of the housing and the side walls of the slot of the rotor relative to which the blade shifts are worn; and (ii) the function as a solid lubricant by the powdered graphite, carbon, etc. generated as the result of the wear of the blade which is usually made from those materials does not occur because of the coating of the graphite, etc. with the wear resistant material.

Contrarily, as will become apparent later, in the present invention, since the blade has only its longitudinal ends coated with a material having a superior wear resistance:

(i) the wear of the parts relative to which the blade shifts is decreased;

(ii) the powdered graphite, carbon, etc. can effectively function as a solid lubricant because of the wear of the other parts of the blade; and (iii) the pump operation is assured owing to the lack of wear of the longitudinal ends of the blade. (Even if the parts of the blade other than the longitudinal ends wear, the pump operation is not affected since the blade is urged radially outwards due to centrifugal force.).

SUMMARY OF THE INVENTION

It is a primary object of the present invention to provide a pump means of the kind referred to above rotary pump which can eliminate the difficulties explained above as encountered in a conventional pump means of this kind.

It is another object of the present invention to provide a pump means of the kind referred to above in which blades incorporated therein can be operated for a long period of time without being lubricated.

It is a further object of the present invention to provide a pump means of the kind referred to above which exhibits only a low decrease in pump performance over a long period of time of operation and which is stable in operation.

In accordance with the present invention, a pump means of the kind referred to above is provided in which the blade is constituted from graphite, an aluminium alloy, a ceramic, a synthetic resin, or the like, and the extreme longitudinal end surfaces which carry out a shifting motion relative to the bracket and the housing of the pump are coated with a synthetic resin or else have a synthetic resin film applied thereto, the resin being wear-resistant, heat-resistant, and having a low coefficient of friction.

BRIEF DESCRIPTION OF THE DRAWINGS

These and other objects of the present invention will become more readily apparent upon reading the following specification and upon reference to the accompanying drawings, in which;

FIG. 2 is a cross sectional view of the pump means shown in FIG. 1 taken along the line II—II of FIG. 1; and .

DESCRIPTION OF THE PREFERRED EMBODIMENTS

Figure 1:
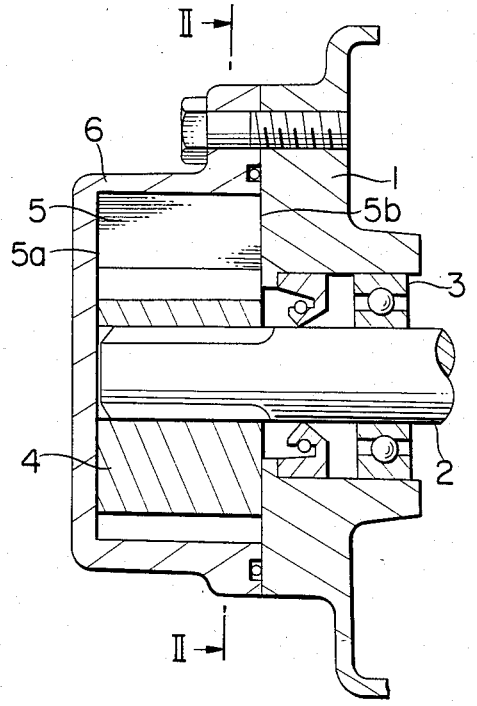
FIG. 1 PRIOR ART
FIG. 1 is a longitudinal sectional view of the principal portion of a conventional rotary pump to the blades of which the improvement in accordance with the present invention is directed.
Figure 3:
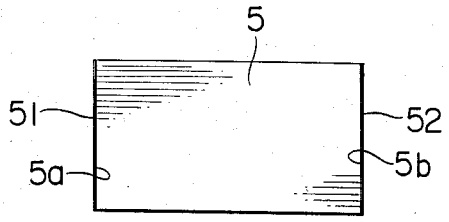
FIGS. 3 and 4 are side elevational views illustrating two different embodiments of the blade in accordance with the present invention.
Figure 2:
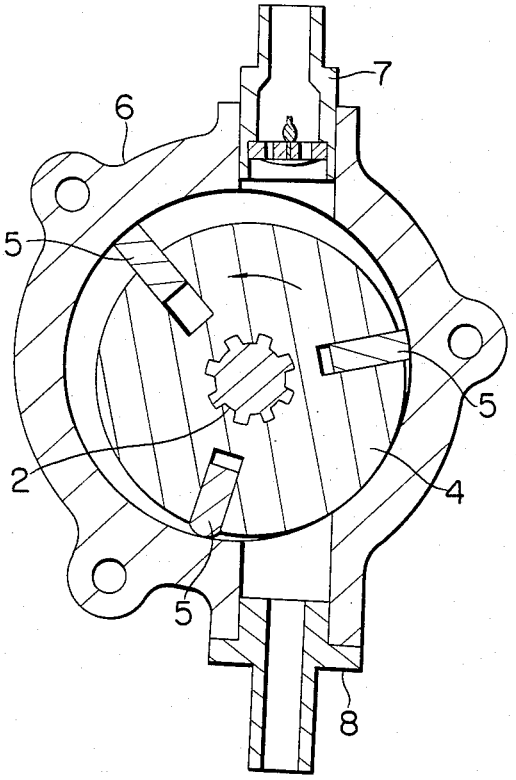
FIG. 2 PRIOR ART

Reference is now made to FIG. 3 of the accompanying drawings wherein is shown a blade 5 embodying the present invention in one of its preferred manners. The blade 5 has its basic body constituted from a material which is a solid lubricant such as graphite, and only the end surfaces 5*a* and 5*b* at the extreme longitudinal ends of the blade 5, which during pump operation shift relative to the bracket 1 and the housing 6 as shown in FIGS. 1 and 2, are entirely covered with coating layers 51 and 52, respectively, made of a synthetic resin having superior wear resistance and heat resistance, and a low coefficient of friction.

Figure 4:
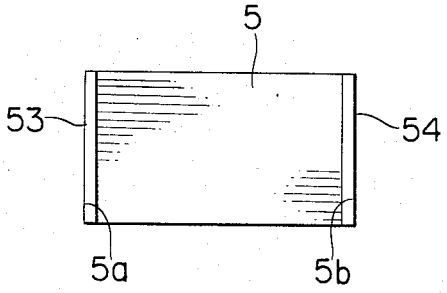

FIG. 4 shows another embodiment of the present invention in which the blade 5 has only its extreme longitudinal end surfaces 5*a* and 5*b*, which shift relative to the bracket 1 and the housing 6, covered with synthetic resin film layers 53 and 54, respectively. The resin has the same characteristics as the resin used for the layers 51 and 52. The resin film layers 53 and 54 are applied so as to extend around the edges of the longitudinal end surfaces 5*a* and 5*b* and to protect the edges as well.

With these synthetic resin layers 51 and 52 or synthetic resin film layers 53 and 54, the coefficient of friction between the blades 5 and the bracket 1 as well as the housing 6 is decreased, improving the shifting properties of the blades 5, and by the use of such a synthetic resin having excellent heat resistance and wear resistance as stated above the decrease in pump performance experienced by prior pump means is also prevented, prolonging the life of the pump means. As can be seen, although the radially outward peripheral surface of the blade 5 is not provided with the resin coating layer or have the resin film layer applied thereto, since the powders generated as the result of the abrasion of the blade body act as a kind of solid lubricant no loss in pumping operation occurs, even if the radially outward periphery surface of the blade 5 is worn away since the blade 5 protrudes radially outwards due to centrifugal force.

Here a few numerical examples will be given in connection with the embodiments illustrated in FIGS. 3 and 4.

It is assumed that the discharge volume of the pump means is 30 c.c./rpm at a rotational speed of 3,000 rpm, and the dimensions of the blade 5 are 29 mm (width)×14.5 mm (height)×4 mm (thickness).

In the blade 5 shown in FIG. 3 the coating layers 51 and 52 are layers of fluorinated ethylene propylene or polyimide having a thickness of 50$\mu$, baked after spraying, and in the blade 5 shown in FIG. 4 the synthetic resin film layers 53 and 54 are perfluoroethylene films attached by adhesives.

The amount of wear of the extreme longitudinal end surfaces of the blade 5 after 500 hours of operation is shown below together with the results for a conventional blade without coating layers or synthetic resin films:

Conventional Blade: 90$\mu$/500 h; and

Blade According to Present Invention: 7.5$\mu$/500 h.

It is to be understood that although certain forms of this invention have been illustrated and described, it is not to be limited thereto except insofar as such limitations are included in the following claims.

What is claimed is:

1. In a rotary pump means having a cylindrical housing having axial inner end surfaces and a cylindrical inner peripheral surface between said end surfaces, formed with air suction and discharge ports, a rotary shaft rotatably mounted within said housing such that the center line of said shaft is disposed eccentrically with respect to the center line of said cylindrical inner peripheral surface of said housing, a bracket rotatably supporting said rotary shaft in association with said housing, a rotor having radial slots therein, concentrically secured to said rotary shaft and eccentrically positioned with respect to said center line of said cylindrical inner peripheral surface of said housing, and a number of blades each radially shiftably received in respective ones of said radial slots formed in said rotor such that during pump operation the radially outward peripheral surfaces and radially extending axial end surfaces of said blades are always in respective contact with said end surfaces and said cylindrical inner peripheral surface of said housing and adapted to suck the air through said air suction port to discharge the air through said discharge port, the improvement wherein said blades are integrally formed of a solid lubricating material exposed on the side surfaces thereof and said radially outward peripheral surfaces thereof, only the axial ends, including said end surfaces, of said blades being coated with layers of synthetic resin having excellent resistance to heat and wear and a low coefficient of friction.

2. A pump means as claimed in claim 1 wherein said synthetic resin layers are film layers of said synthetic resin.

3. A pump means as claimed in claim 1 wherein said solid lubricating material is graphite.

* * * * *